US005509774A

United States Patent [19]

Yoo

[11] Patent Number: 5,509,774

[45] Date of Patent: Apr. 23, 1996

[54] LOAD CLAMPING APPARATUS WITH AN INCREASED EXTENT OF VERTICAL MOVEMENT

[75] Inventor: Jae S. Yoo, Seoul, Rep. of Korea

[73] Assignee: Daewoo Heavy Industries Ltd., Inchen, Rep. of Korea

[21] Appl. No.: 340,401

[22] Filed: Nov. 15, 1994

[30] Foreign Application Priority Data

Nov. 16, 1993 [KR] Rep. of Korea ..... 93-24010(U.)

[51] Int. Cl.[6] ..... B66F 9/18

[52] U.S. Cl. ..... 414/622; 187/237

[58] Field of Search ..... 187/222, 226, 187/237, 238, 254, 255, 266, 272; 414/622, 621

[56] References Cited

U.S. PATENT DOCUMENTS

| | | | |
|---|---|---|---|
| 2,807,382 | 9/1957 | Schenkelberger | 414/622 X |
| 4,392,773 | 7/1983 | Johannson . | |
| 4,896,748 | 1/1990 | Mikkelsen et al. . | |

FOREIGN PATENT DOCUMENTS

| | | | |
|---|---|---|---|
| 218299 | 1/1990 | Japan | 414/622 X |

*Primary Examiner*—William E. Terrell

*Assistant Examiner*—Dean A. Reichard

*Attorney, Agent, or Firm*—Lowe, Price, LeBlanc & Becker

[57] ABSTRACT

A load clamping apparatus is provided for use with a forklift truck including a mast having a vertical guide channel, a lift carriage mounted to the mast for elevational movement therealong and a pair of spaced apart forks carried by the lift carriage to support a load to be handled. The load clamping apparatus comprises: a slider member slidably fitted into the vertical guide channel and elevationally movable along the mast, the slider member having a vertical guide groove; a clamp carriage slidably fitted into the vertical guide groove of the slidable member for pressing the load against the pair of spaced apart forks; an actuator pivotally affixed to the mast for causing the slider member to move up and down; upper and lower rotary guide rollers each rotatably mounted to top and bottom ends of the slider member; a first pliable connector having a first end anchored to the mast and a second end fixedly secured to the clamp carriage, the first pliable connector extending upwardly from the first end thereof, turning around the upper rotary guide rollers and then extending downwardly to reach the second end thereof; and a second pliable connector having a first end anchored to the mast and a second end fixedly secured to the clamp carriage, the second pliable connector extending downwardly from the first end thereof, turning around the lower rotary guide rollers and then extending upwardly to reach the second end thereof.

7 Claims, 5 Drawing Sheets

LOAD CLAMPING APPARATUS WITH AN INCREASED EXTENT OF VERTICAL MOVEMENT

FIELD OF THE INVENTION

The present invention pertains generally to a forklift truck, and more particularly to a load clamping apparatus for use with the forklift truck that has a clamp carriage elevationally movable over an increased extent of vertical movement to press down the load against tines or forks of a lift carriage.

DESCRIPTION OF THE PRIOR ART

Extensive use has been made of forklift trucks to lift up loads, cargos, freights and the like (hereinbelow referred to as "load") for the purpose of their shipment and transportation from one place to another. Conventional forklift trucks customarily carry a vertically oriented mast assembly to which a carriage assembly is mounted for elevational movement therealong to raise the load up to a desired elevation. The carriage assembly is provided with a pair of spaced apart, generally parallel forks that overhang from the carriage assembly so as to take up the vertically exerted force of the load. The up/down movement of the carriage assembly may be rendered effective by the combination of a lift jack and a lift chain associated therewith. Side shift cylinders are also employed to have the carriage assembly move laterally, if appropriate. Lateral movement of the carriage assembly makes it possible for the forklift truck to readily access to the load even in a narrow working space and to permit unshipment of the lifted load on a precise location.

U.S. Pat. No. 4,392,773 dated Jul. 12, 1983 to Johannson teaches a carriage assembly with shiftable forks so designed that all vertical forces are taken up by a lower bar to render tile upper portion of tile carriage assembly relatively light and small, thus allowing clear forward and downward vision for the vehicle operator. A primary feature of the '773 patent is that substantially only the horizontal forces are transferred to an upper bar of a side shifter, with the vertical forces to a lower bar of the side shifter.

U.S. Pat. No. 4,896,748 dated Jan. 30, 1990 to Mikkelsen et al. discloses a full free lift mast assembly that can significantly reduce bending of carriage lift jacks, fluid leakage, missequencing and like problems. The full free lift mast assembly has a first pair of spaced apart uprights, a second pair of spaced apart uprights mounted on the first pair of uprights and elevationally movable therealong and a carriage mounted on the second pair of uprights. A first mast lift jack is connected between the first and second pairs of spaced apart uprights, first and second interconnected carriage lift jacks being pivotally connected to and between the second pair of spaced apart uprights and the carriage. A connecting arrangement serves to couple cylinders of the first and second carriage lift jacks and maintains them parallel in a preselected overlapping relationship with each other.

The afore-mentioned and other prior art forklift trucks are, however, adapted to perform the load lifting and transporting operation with tile load simply placed on the forks, which would frequently result in a reduced stability or even falling-down of the load from the carriage during the course of handling same. This is particularly true for the bulky and light weight load which has a higher gravitational center. For the reason stated above, it would be desirable to provide a way of stabilizing the load when they are lifted up and transported.

SUMMARY OF THE INVENTION

Accordingly, it is an object of the present invention to provide a load clamping apparatus for use with a forklift truck that substantially eliminates the drawbacks inherent in the prior art forklift trucks and that can exert a downward clamping force against the load placed on a lift carriage to assure a stabilized handling thereof.

Another object of the invention is to provide a load clamping apparatus capable of increasing the vertical movement extent of a clamp carriage without the need to use a hydraulic actuator of overly extended stroke length.

In accordance with the invention, a load clamping apparatus is provided for use with a forklift truck which includes a mast having a vertical guide channel, a lift carriage mounted to the mast for elevational movement therealong and a pair of spaced apart forks carried by the lift carriage to support a load to be handled. The load clamping apparatus comprises: a slider member slidably fitted into the vertical guide channel and elevationally movable along the mast, the slider member having a vertical guide groove; a clamp carriage slidably fitted into the vertical guide groove of the slider member for pressing the load against the pair of spaced apart forks; an actuator pivotally affixed to the mast for causing the slider member to move up and down; upper and lower rotary guide rollers each rotatably mounted to top and bottom ends of the slider member; a first pliable connector having a first end anchored to the mast and a second end fixedly secured to the clamp carriage, the first pliable connector extending upwardly from the first end thereof, turning around the upper rotary guide roller and then extending downwardly to reach the second end thereof; and a second pliable connector having a first end anchored to the mast and a second end fixedly secured to the clamp carriage, the second pliable connector extending downwardly from the first end thereof, turning around the lower rotary guide means and then extending upwardly to reach the second end thereof.

BRIEF DESCRIPTION OF THE DRAWINGS

Other objects, features and advantages of the invention will become apparent from the following description of the preferred embodiment taken in conjunction with the drawings in which.

DETAILED DESCRIPTION OF THE PREFERRED EMBODIMENT

Figure 1:
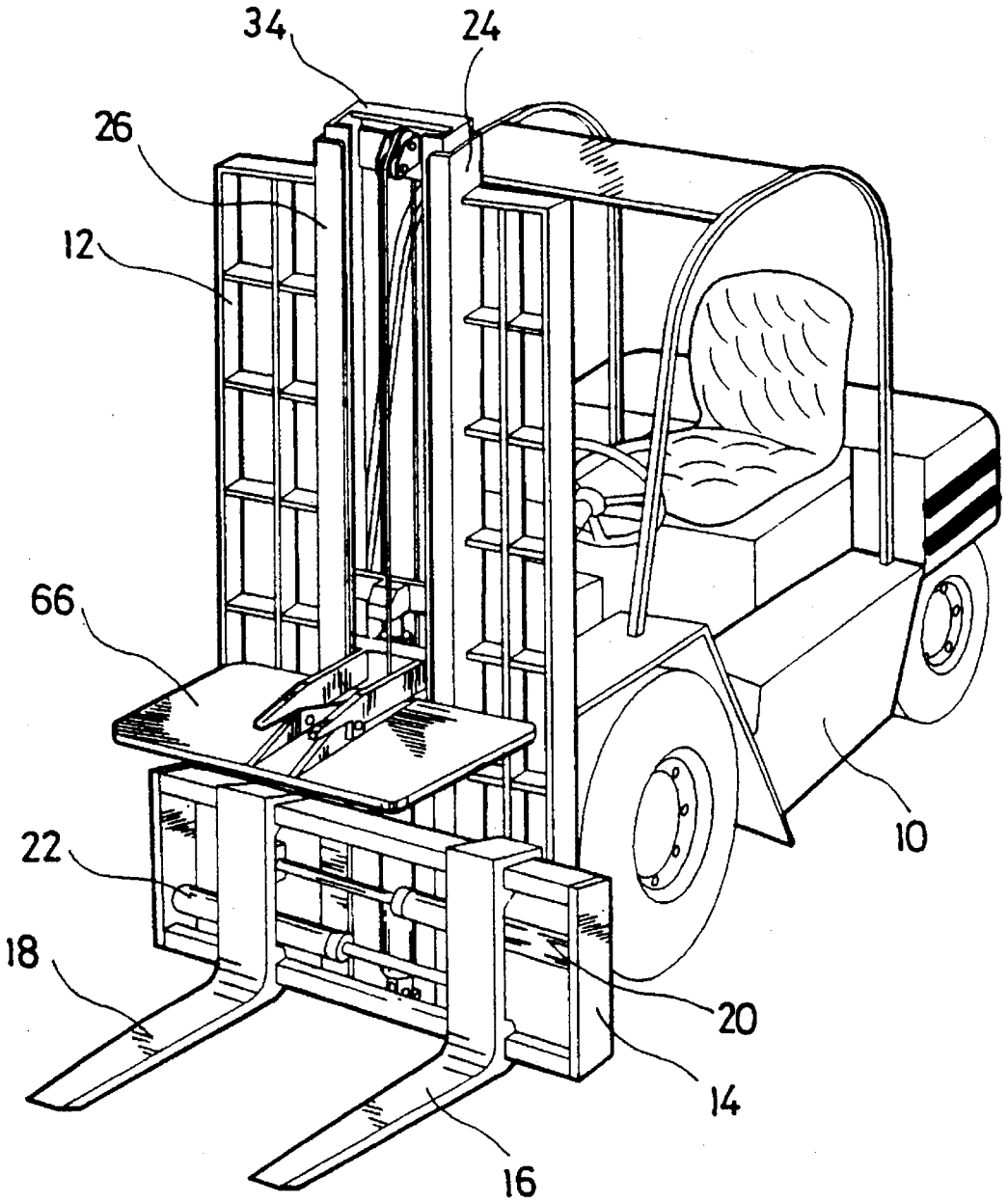
FIG. 1 is a perspective view showing by way of example a forklift truck that makes use of the inventive load clamping apparatus.

Referring now to FIG. 1, a forklift truck is shown to include a vehicle body 10, a vertically oriented mast 12 in front of the vehicle body 10 and a lift carriage 14 slidably mounted to the mast 12 for elevational movement thereal-ong. The lift carriage 14 may be laterally shifted by means of a suitable hydraulic actuator not shown in the drawings for simplicity.

The lift carriage 14 is provided with a pair of spaced apart, generally "L" shaped forks or tines 16, 18 which are movable toward and away from each other as by first and second side shift cylinders 20, 22. To raise a load of relatively large transverse dimension, the spacing of the individual forks 16, 18 should preferably remain broad, while the spacing has to be narrowed to lift up a load having relatively small transverse dimension. In a typical forklift truck, the lift carriage 14 is adapted to move vertically by virtue of a lift cylinder and a lift chain (not shown).

Figure 2:
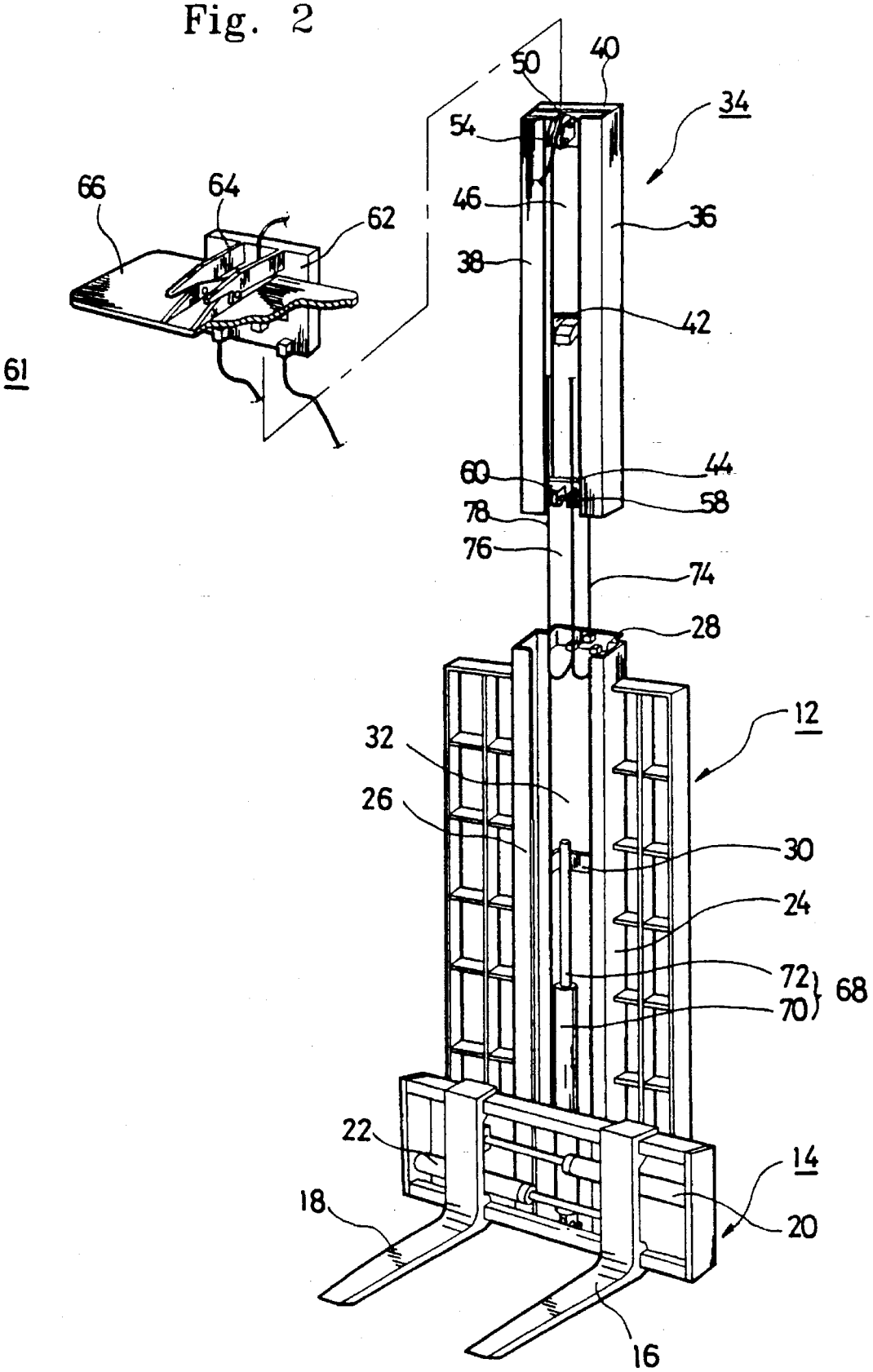
FIG. 2 is an exploded perspective view of the load clamping apparatus, with ropes for interconnecting the mast and the clamp carriage severed for illustrative purpose only.
Figure 3:
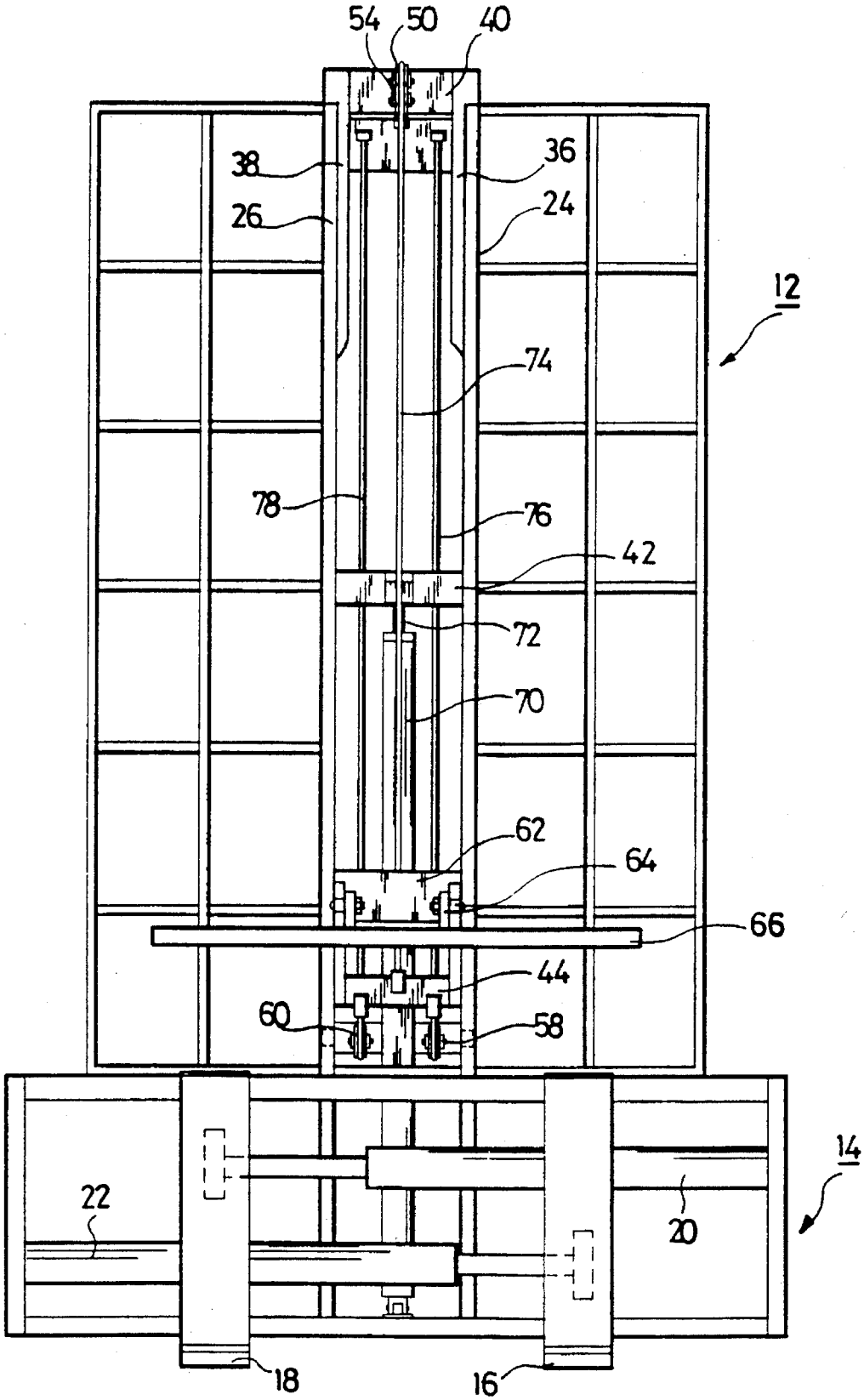
FIG. 3 is a front elevational view illustrating the load clamping apparatus with the clamp carriage brought into a lowermost position.

Turning to FIGS. 2 and 3, the mast 12 includes first and second guide rails 24, 26 of generally "U" shaped cross-section each disposed in an opposing relationship to one another with an appropriate spacing therebetween. These guide rails 24, 26 may be mutually connected through the use of top and intermediate plate-like brackets 28, 30. A vertical guide channel 32 is defined between the guide rails 24, 26 to accommodate a slider member 34 in a vertically movable way. The slider member 34 is composed of first and second side frames 36, 38 having generally "U" shaped cross-section, each of the side frames 36, 38 being in a opposing relationship to one another. The side frames 36, 38 are connected with each other by means of uniformly spaced, top, intermediate and bottom cross-bars 40, 42, 44. As a result, a vertical guide groove 46 is defined between the side frames 36, 38 to accommodate the carrier member of a clamp carriage set forth below.

An upper rotary guide means is mounted on the top cross-bar 40, with a lower rotary guide means on the bottom cross-bar 44. As is clearly shown in FIG.4, the upper rotary guide means includes a first center roller 50 carried by the top cross-bar 40 for rotation about a first axis 48 and a second center roller 54 carried by the top cross-bar 40 for rotation about a second axis 52 which is offset forwardly downwardly from the first axis 48. Furthermore, the lower rotary guide means includes a pair of parallel side rollers 58, 60 that are coaxially disposed on a third axis 56 with an appropriate spacing therebetween. It is perferred that the first and third axes 48, 56 should lie on a common vertical plane. While, in the illustrated embodiment, rollers are used as the upper and lower rotary guide means, it would be possible to employ pulleys or other suitable rotary bodies in place of the rollers.

With reference to FIGS. 1 through 4, it can be appreciated that a clamp carriage 61 is combined with the slider member 34 for vertical sliding movement therealong. The clamp carriage 61 includes a carrier member 62 slidably fitted into the vertical guide groove 46 of the slider member 34, a support bracket 64 protruding forwardly from the carrier member 62 and a pressure plate 66 pivotally mounted on the support bracket 64. Since the pressure plate 66 is to come into contact with the load placed on the lift carriage 14, it may be desirable to attach a compliant pad made of rubber or other soft material to the underside of the pressure plate 66.

Pivotally mounted on the mast 12 is an actuator 68 that consists of a hydraulic cylinder 70 and a piston rod 72 extendibly fitted into the hydraulic cylinder 70. The piston rod 72 is connected at its distal end to the intermediate cross-bar 42 of the slider member 34, thus enabling the actuator 68 to raise and lower the slider member 34 at the vehicle operator's will.

Figure 4:
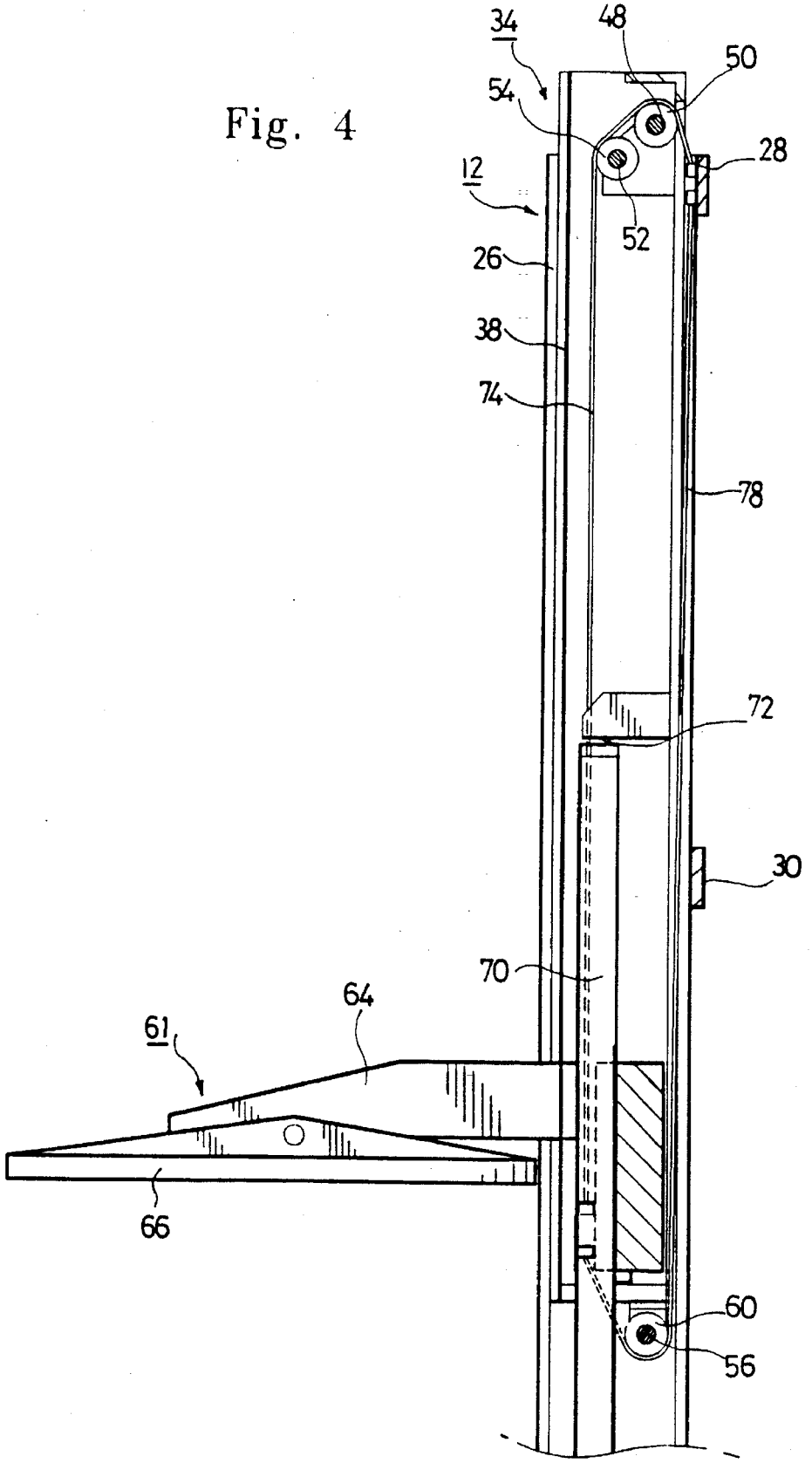
FIG. 4 is a schematic cross-sectional view best showing the positional relationship of the guide rollers and the ropes.

As can be seen in FIGS. 2, 3 and 4, the clamp carriage 61 is coupled to the mast 12 by virtue of first and second pliable connecting means. Preferably, the first pliable connecting means includes a center rope 74 having a first end anchored to the top bracket 28 of the mast 12 and a second end fixedly secured to the carrier member 62 of the clamp carriage 61. The center rope 74 extends upwardly from the first end thereof to turn around the first and second center rollers 50, 54 and then goes downwardly from the rollers 50, 54 to reach the second end thereof. Accordingly, as the slide member 34 moves upward by the actuator 68, the second end side vertical extension of the center rope 74 will gradually become shorter, with the first end side vertical extension longer, so as to cause the clamp carriage 61 to be pulled upwardly.

The second pliable connecting means includes a pair of parallel side ropes 76, 78, each of which has a first end anchored to the top bracket 28 of the mast 12 and a second end fixedly secured to the carrier member 62 of the clamp carriage 61. As is apparent from FIG. 4, the respective side rope 76 or 78 extends downwardly from the first end thereof to turn around each of the side rollers 58, 60 and then goes upwardly toward the second end. Thus, as the slider member 34 moves downwardly by the actuator 68, the second end side vertical extension of each of the side ropes 76, 78 will gradually become shorter, with the first end side vertical extension longer, thereby causing the clamp carriage 61 to be pulled in the downward direction. Alternatively, the ropes 74, 76, 78 may be replaced with chains and, therefore, use of the chains as the first and second pliable connecting means should fall within the coverage of the invention.

In the following, description will be given as to the operation of the instant load clamping apparatus with reference to FIGS.5A, 5B and 5C.

Figure 5C:
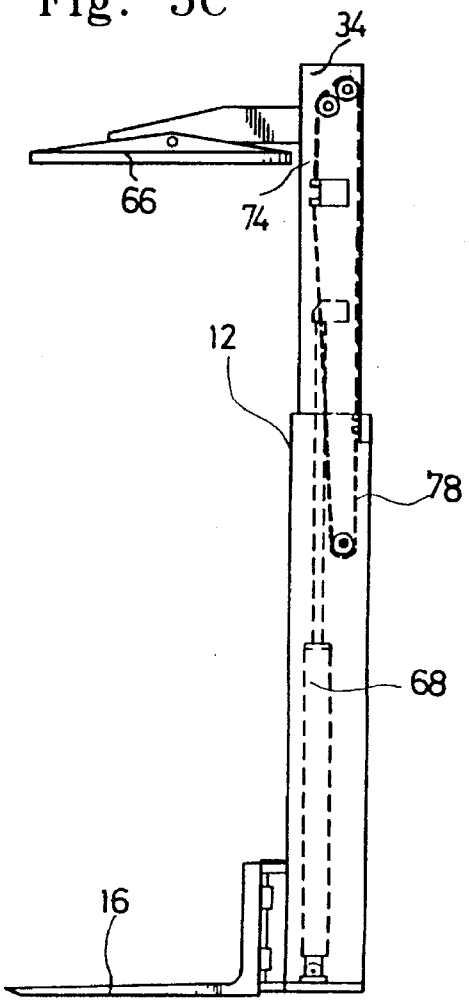
FIGS. 5A, 5B and 5C show the positional relationship of various moving parts when the piston rod of the actuator is in a fully retracted position, a half-extended position and a fully extended position, respectively.
Figure 5B:
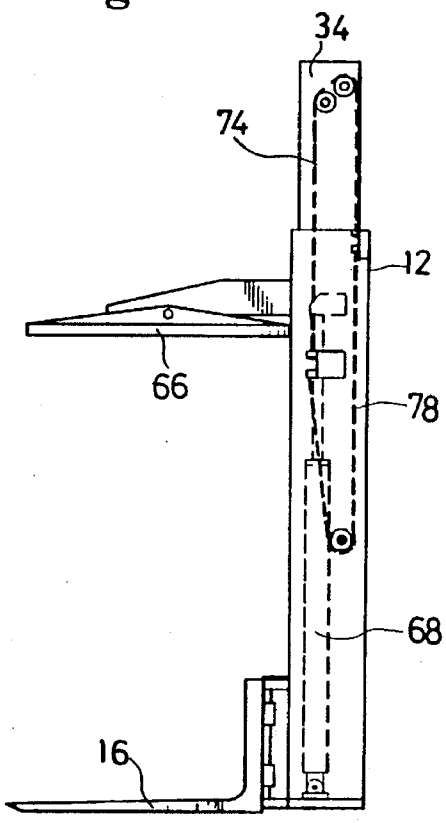
Figure 5A:
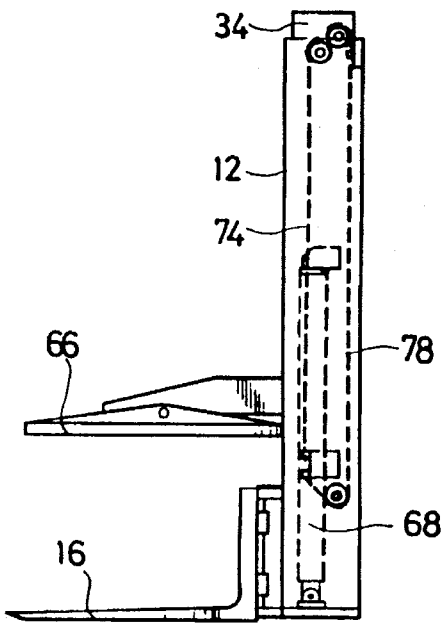

FIG. 5A shows a first illustrative operation mode of the load clamping apparatus wherein the piston rod 72 of the actuator 68 is fully retracted, with the slider member 34 and the clamp carriage 61 brought into the lowermost position. Under this state, configuration of the center rope 74 is such that the second end side vertical extension thereof remains longest and the first end side vertical extension is kept shortest. In contrast, the second end vertical side extension of the respective side rope 76 or 78 becomes shortest and the first end side vertical extension thereof is maintained long-est. As a consequence, the clamp carriage 61 would be pulled downwardly along the slider member 34 into the lowermost Position whereby the spacing between the forks 16, 18 and the pressure plate 66 is minimized to assure positive clamping of a low profile load.

FIG. 5B depicts a second illustrative operation mode of the load clamping apparatus wherein the piston rod 72 of the actuator 68 is in a half-extended position. In response to the extending movement of the piston rod 72, the slider member 34 is brought into a middle position, with the result that the center rope 74 should be pressed by the rollers 50, 52 in the upward direction. Accordingly, the second end side extension of the center rope 74 becomes shorter and the first end side extension thereof is rendered longer in proportion to the reduction in length of the second end side extension. This means that the clamp carriage 61 is moved upwardly twice as far as the extension length of the piston rod 72, as readily understood from the comparison of FIGS. 5A and 5B.

FIG. 5C represents a third illustrative operation mode of the load clamping apparatus wherein the piston rod 72 of the actuator 68 is in a fully extended position. Responsive to such an extending movement of the piston rod 72, the slider member 34 is brought into the uppermost position, which in turn cause the rollers 50, 52 to further press the center rope 74 upwardly. Therefore, the second end side extension of the center rope 74 becomes shortest and the first end side extension thereof is rendered longest. This allows the clamp carriage to be pulled up to the top edge of the slider member 34, thereby maximizing the spacing between the forks 16, 18 and the pressure plate 66 for ready accommodation of a high profile load.

In a case where the piston rod 72 is retracted from the position shown in FIG. 5C, the slider member 34 descends in exact proportion to the retraction length of the piston rod 72 but the side ropes 76, 78 move downwardly twice as far as the retraction length of the piston rod 72 to eventually come back to the position illustrated in FIG. 5A.

While the invention has been shown and described with reference to a preferred embodiment, it should be apparent to those skilled in the art that many changes and modifications may be made without departing from the scope of the invention as defined in the claims.

What is claimed is:

1. A load clamping apparatus for use with a forklift truck including a mast having a vertical guide channel, a lift carriage mounted to the mast for elevational movement therealong and a pair of spaced apart forks carried by the lift carriage to support a load to be handled, the apparatus comprising:

a slider member slidably fitted into the vertical guide channel and elevationally movable along the mast, the slider member having a vertical guide groove;

a clamp carriage slidably fitted into the vertical guide groove of the slider member for pressing the load against the pair of spaced apart forks;

an actuator pivotally affixed to the mast for causing the slider member to move up and down;

upper and lower rotary guide means each rotatably mounted to top and bottom ends of the slider member;

first pliable connecting means having a first end anchored to the mast and a second end fixedly secured to the clamp carriage, the first pliable connecting means extending upwardly from the first end thereof, turning around the upper rotary guide means and then extending downwardly to reach the second end thereof; and second pliable connecting means having a first end anchored to the mast and a second end fixedly secured to the clamp carriage, the second pliable connecting means extending downwardly from the first end thereof, turning around the lower rotary guide means and then extending upwardly to reach the second end thereof.

2. The load clamping apparatus as recited in claim 1, wherein the clamp carriage comprises a carrier member slidably fitted into the vertical guide groove of the slider member, a support bracket protruding from the carrier member forwardly and a pressure plate pivotally attached to a distal end of the support bracket.

3. The load clamping apparatus as recited in claim 2, wherein the upper rotary guide means comprises a first center roller rotatably mounted to the top end of the slider member for rotational movement about a first axis and a second center roller mounted to the slider member in proximity with the first center roller for rotational movement about a second axis offset forwardly downwardly from the first axis, and wherein the lower rotary guide means comprises a pair of spaced apart side rollers mounted to the bottom end of the slider member for rotational movement about a third axis.

4. The load clamping apparatus as recited in claim 3, wherein the first pliable connecting means comprises a center rope extending between the mast and the carrier member of the clamp carriage to turn around the first and second center rollers so that any upward movement of the slider member can cause the clamp carriage to be pulled upwardly by the center rope, and wherein the second pliable connecting means comprises a pair of side ropes each extending between the mast and the carrier member of the clamp carriage to turn around the pair of side rollers so that any downward movement of the slider member can cause the clamp carriage to be pulled downwardly by the side ropes.

5. The load clamping apparatus as recited in claim 3, wherein the first pliable connecting means comprises a center chain extending between the mast and the carrier member of the clamp carriage to turn around the first and second center rollers so that any upward movement of the slider member can cause the clamp carriage to be pulled upwardly by the center chain, and wherein the second pliable connecting means comprises a pair of side chains each extending between the mast and the carrier member of the clamp carriage to turn around the pair of side rollers so that any downward movement of the slide member can cause the clamp carriage to be pulled downwardly by the side chains.

6. The load clamping apparatus as recited in claim 4, wherein the actuator comprises a hydraulic cylinder pivotally mounted to the mast and a piston rod extendibly fitted into the hydraulic cylinder, the piston rod connected at its distal end to the slider member.

7. The load clamping apparatus as recited in claim 5, wherein the actuator comprises a hydraulic cylinder pivotally mounted to the mast and a piston rod extendibly fitted into the hydraulic cylinder, the piston rod connected at its distal end to the slider member.

* * * * *